US006808678B2

(12) United States Patent
Murakami et al.

(10) Patent No.: US 6,808,678 B2
(45) Date of Patent: Oct. 26, 2004

(54) STEEL PLATE FOR ENAMELING, HAVING IMPROVED FORMABILITY, ANTI-AGING PROPERTY, AND ENAMELING PROPERTIES, AND PROCESS FOR PRODUCING THE SAME

(75) Inventors: Hidekuni Murakami, Kitakyushu (JP); Satoshi Nishimura, Kitakyushu (JP); Kazuhisa Kusumi, Kitakyushu (JP); Shiroh Sanagi, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 129 days.

(21) Appl. No.: 10/070,050

(22) PCT Filed: Jun. 25, 2001

(86) PCT No.: PCT/JP01/05420

§ 371 (c)(1),
(2), (4) Date: Feb. 21, 2002

(87) PCT Pub. No.: WO01/98551

PCT Pub. Date: Dec. 27, 2001

(65) Prior Publication Data

US 2002/0144755 A1 Oct. 10, 2002

(30) Foreign Application Priority Data

Jun. 23, 2000 (JP) ..... 2000-190227

(51) Int. Cl.[7] ..... C22C 38/00
(52) U.S. Cl. ..... 420/121
(58) Field of Search ..... 420/121, 128

(56) References Cited

U.S. PATENT DOCUMENTS 4,348,229 A 9/1982 Suemune et al.
5,078,809 A 1/1992 Kinoshita et al.
5,445,686 A * 8/1995 Ueshima et al. ..... 148/330
5,486,241 A * 1/1996 Ushioda et al. ..... 148/330
6,478,892 B2 * 11/2002 Murakami et al. ..... 148/306
6,544,355 B1 * 4/2003 Nishimura et al. ..... 148/332
6,562,152 B2 * 5/2003 Murakami et al. ..... 148/430

FOREIGN PATENT DOCUMENTS

| | | |
|---|---|---|
| EP | 386758 | 9/1990 |
| EP | 0 769 565 A1 | 4/1997 |
| JP | 8-27522 | 1/1996 |
| JP | 9-137250 | 5/1997 |

OTHER PUBLICATIONS

Patent Abstracts of Japan; JP 08 199299 A, Aug. 6, 1996, vol. 1996, No. 12, Dec. 26, 1996.

* cited by examiner

*Primary Examiner*—Daniel J. Jenkins
(74) *Attorney, Agent, or Firm*—Kenyon & Kenyon

(57) ABSTRACT

Disclosed is the provision of a non-aging, highly anti-seed and anti-black-speck steel plate for enameling without relying upon decarbonization-denitrification annealing involving increased production cost, and without the addition of expensive elements, such as niobium and titanium involving increased alloying cost. This steel plate is produced by adopting a steel composition comprising, by weight, carbon: not more than 0.0018%, silicon: not more than 0.020%, manganese: 0.10 to 0.30%, phosphorus: 0.010 to 0.030%, sulfur: not more than 0.030%, aluminum: not more than 0.005%, nitrogen: 0.0008 to 0.0050%, boron: not more than 0.0050% and not less than 0.6 time the nitrogen content, and oxygen: 0.010 to 0.05%, and regulating the chemical composition of the steel and regulating mainly hot rolling conditions to regulate the form of nitrides.

3 Claims, 1 Drawing Sheet

STEEL PLATE FOR ENAMELING, HAVING IMPROVED FORMABILITY, ANTI-AGING PROPERTY, AND ENAMELING PROPERTIES, AND PROCESS FOR PRODUCING THE SAME

BACKGROUND OF THE INVENTION

1. Field of the Invention

The present invention relates to a steel plate for enameling which can be produced at low cost and possess improved (excellent) enameling properties, formability, and anti-aging property, and a process for producing the same.

2. Background Art

Steel plates for enameling have hitherto been produced by decarbonization and denitrification annealing to reduce carbon content and nitrogen content to not more than several tens of ppm. The decarbonization and denitrification annealing, however, has drawbacks of low productivity and high production cost.

In order to avoid decarbonization and denitrification annealing, for example, Japanese Patent Laid-Open No. 122938/1994 and Japanese Patent No. 2951241 disclose steel plates for enameling, using ultra low carbon steels, wherein the carbon content has been reduced to several tens of ppm by degassing at the point of steelmaking. In these techniques, in order to eliminate the adverse effect of carbon in solid solution or nitrogen in solid solution left in very small amounts in the steel, titanium, niobium and the like are added to improve deep-drawability and anti-aging property.

In this method, however, seeds and black speck defects attributable to carbides and nitrides are likely to occur. In addition, the production cost is disadvantageously increased due to alloying cost of titanium, niobium and the like.

Steel plates for enameling with the amount of titanium, niobium and the like added being reduced and a process for producing the same are disclosed, as steel plates and the production process thereof which can solve these problems, in Japanese Patent Laid-Open Nos. 27522/1996, 137250/1997, and 212546/1998, although these plates have somewhat inferior drawability. In these methods, boron is mainly used in the fixation of nitrogen.

In the methods disclosed in the above publications, however, a reduction in carbon in solid solution is not satisfactory under some production conditions. Further, redissolution of nitrides during annealing leads to increased nitrogen which causes age deterioration and thus disadvantageously deteriorates press formability. In addition, disadvantageously, the evolution of gas, for example, due to the decomposition of nitrides during baking of porcelain enamel, is likely to cause seeds and black speck defects.

SUMMARY OF THE INVENTION

Accordingly, it is an object of the present invention to solve the above problems of the conventional steel plates for enameling and to provide non-aging steel plates for enameling, which have excellent anti-seed and anti-black-speck properties, can be produced at low cost, and have good formability, and a process for producing the same.

The present inventors have repeatedly made various studies with a view to overcoming the drawbacks of the conventional steel plates and the conventional production process of steel plates. More specifically, the present inventors have made studies on the influence of chemical composition and production conditions on the aging property and enameling properties of steel plates for enameling. As a result, the present invention has been made based on the following findings (1) to (5).

(1) Mere addition of carbide formers is unsatisfactory for the suppression of aging and seeds and black specks, and the absolute value of the carbon content should be reduced to not more than a certain value.

(2) The aging property and the occurrence of seeds and black specks are influenced by the type of nitrides, and the anti-aging property and the anti-seed and anti-black-speck properties are improved by the formation of boron nitride rather than aluminum nitride.

(3) The aging property and the occurrence of seeds and black specks are influenced by the form of boron nitride, and the anti-aging property and the anti-seed and anti-black-speck properties are improved by regulating the content and size of boron nitride so as to fall within respective specific ranges.

(4) Not only the regulation of nitrogen and boron contents but also the regulation of particularly oxygen content and hot rolling conditions is useful for the regulation of the state of the nitride in the above manner.

(5) In steels wherein carbon, phosphorus, nitrogen, and boron contents and the state of nitride have been properly regulated, the optimal skin pass reduction range for maintaining good anti-aging property and formability can be broadened.

The present invention is based on the above facts, and the subject matters of the present invention are as follows.

(1) A steel plate for enameling, having improved formability, anti-aging property, and enameling properties, comprising by mass carbon: not more than 0.0018%,
silicon: not more than 0.020%,
manganese: 0.10 to 0.30%,
phosphorus: 0.010 to 0.035%,
sulfur: not more than 0.035%,
aluminum: not more than 0.010%,
nitrogen: 0.0008 to 0.0050%,
boron: not more than 0.0050% and not less than 0.6 time the nitrogen content, and
oxygen: 0.005 to 0.050%,
(nitrogen present as BN)/(nitrogen present as AlN) being not less than 10.0,
with the balance consisting of iron and unavoidable impurities.

(2) A steel plate for enameling, having improved formability, anti-aging property, and enameling properties, comprising by mass carbon: not more than 0.0018%,
silicon: not more than 0.020%,
manganese: 0.10 to 0.30%,
phosphorus: 0.010 to 0.035%,
sulfur: not more than 0.035%,
aluminum: not more than 0.010%,
nitrogen: 0.0008 to 0.0050%,
boron: not more than 0.0050% and not less than 0.6 time the nitrogen content, and
oxygen: 0.005 to 0.050%,
(nitrogen present as BN)/(nitrogen content) being not less than 0.80,
with the balance consisting of iron and unavoidable impurities.

(3) A steel plate for enameling, having improved formability, anti-aging property, and enameling properties, comprising by mass carbon: not more than 0.0018%, silicon: not more than 0.020%, manganese: 0.10 to 0.30%, phosphorus: 0.010 to 0.035%, sulfur: not more than 0.035%, aluminum: not more than 0.010%, nitrogen: 0.0008 to 0.0050%, boron: not more than 0.0050% and not less than 0.6 time the nitrogen content, and oxygen: 0.005 to 0.050%, the average diameter of precipitates of BN alone or BN-containing composite precipitates having a diameter of not less than 0.005 μm and not more than 0.50 μm being not less than 0.010 μm, not more than 10% of the number of precipitates of BN alone or BN-containing composite precipitates having a diameter of not less than 0.005 μm and not more than 0.50 μm being accounted for by precipitates having a diameter of not more than 0.010 μm, with the balance consisting of iron and unavoidable impurities.

(4) A process for producing a hot rolled steel plate for enameling, having improved formability, anti-aging property, and enameling properties, comprising the steps of:

hot rolling a cast slab comprising by mass carbon: not more than 0.0018%, silicon: not more than 0.020%, manganese: 0.10 to 0.30%, phosphorus: 0.010 to 0.035%, sulfur: not more than 0.035%, aluminum: not more than 0.010%, nitrogen: 0.0008 to 0.0050%, boron: not more than 0.0050% and not less than 0.6 time the nitrogen content, and oxygen: 0.005 to 0.050%; and then subjecting the hot strip to skin pass rolling with a reduction of not more than 5%.

(5) A process for producing a cold rolled steel plate for enameling, having improved formability, anti-aging property, and enameling properties, comprising the steps of:

hot rolling a cast slab comprising by mass carbon: not more than 0.0018%, silicon: not more than 0.020%, manganese: 0.10 to 0.30%, phosphorus: 0.010 to 0.035%, sulfur: not more than 0.035%, aluminum: not more than 0.010%, nitrogen: 0.0008 to 0.0050%, boron: not more than 0.0050% and not less than 0.6 time the nitrogen content, and oxygen: 0.005 to 0.050%;

cold rolling the hot strip with a cold rolling reduction of not less than 60%;

after the cold rolling, annealing the cold strip at or above the recrystallization temperature; and subjecting the annealed strip to skin pass rolling with a reduction of not more than 5%.

(6) The process for producing a steel plate for enameling, having improved formability, anti-aging property, and enameling properties according to the above item (4) or (5), wherein the cast slab is hot rolled at a slab heating temperature of 1000 to 1150° C.

(7) The process for producing a steel plate for enameling, having improved formability, anti-aging property, and enameling properties according to any one of the above items (4) to (6), wherein the cast slab is hot rolled, and is coiled at 650 to 750° C.

BRIEF DESCRIPTION OF THE DRAWINGS

In FIG. 1, the results of observations on anti-fishscale property are evaluated according to 4 grades. Specifically, X represents the lowest anti-fishscale property, and Δ, ○, and ◎ represent, in that order, better anti-fishscale property.

DETAILED DESCRIPTION OF THE INVENTION

Figure 1:
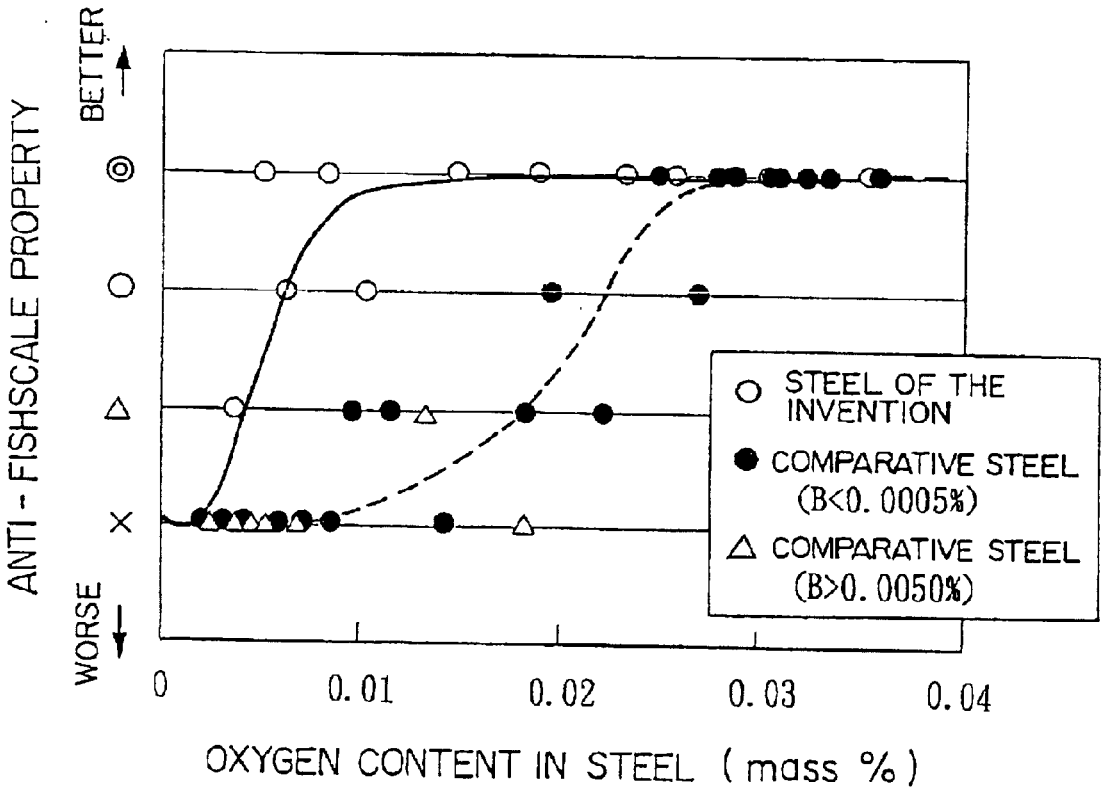
FIG. 1 is a diagram showing the influence of boron content on proper oxygen content for anti-fishscale property.

The present invention will be described in more detail.

The chemical composition of steel will be first described in detail.

For carbon, it is known that the formability of steel improves with lowering the carbon content. In the present invention, the carbon content should be not more than 0.0018% by mass from the viewpoint of offering good anti-aging property, formability, and enameling properties. The carbon content is preferably not more than 0.0015% by mass. Specifying the lower limit of the carbon content is not particularly required. Since, however, lowering the carbon content increases steelmaking cost, the lower limit of the carbon content is preferably 0.0005% by mass from the practical point of view.

Silicon inhibits enameling properties. Therefore, there is no need to intentionally add silicon, and the lower the silicon content, the better the results. The silicon content is approximately the same level as that of the conventional steel plates for enameling, that is, generally not more than 0.020% by mass, preferably not more than 0.010% by mass.

Manganese affects enameling properties in connection with oxygen and sulfur contents. At the same time, manganese is an element which prevents sulfur-derived hot brittleness during hot rolling. In the steel according to the present invention which has high oxygen content, the manganese content should be not less than 0.10% by mass. On the other hand, when the manganese content is high, the adhesion to porcelain enamel is deteriorated and seeds and black specks are likely to occur. For this reason, the upper limit of the manganese content is 0.30% by mass.

When the content of phosphorus is low, the grain diameter is increased and the aging property is increased. On the other hand, when the phosphorus content exceeds 0.035% by mass, the material is hardened. This deteriorates press formability. Further, this increases pickling speed at the time of pretreatment for enameling and increases the amount of smut which is causative of the occurrence of seeds and black specks. For this reason, according to the present invention, the phosphorus content is limited to 0.010 to 0.035% by mass, preferably 0.010 to 0.030% by mass.

Sulfur increases the amount of smut at the time of pickling as the pretreatment for enameling and thus is likely to cause seeds and black specks. Therefore, the sulfur content is limited to not more than 0.035% by mass, preferably not more than 0.030% by mass.

When the content of aluminum is excessively high, the content of oxygen in the steel cannot be regulated so as to fall within the specified content range. Further, also in the regulation of nitrides, aluminum nitride is disadvantageously reacted with moisture during the baking of porcelain enamel to evolve gas which is causative of the formation of seed defects. For this reason, the aluminum content is limited to not more than 0.010% by mass, preferably not more than 0.005% by mass.

In the present invention, nitrogen is an element which is important for regulating the state of BN. A lower nitrogen content is preferred from the viewpoint of the anti-aging property and the anti-seed and anti-black-speck properties. When the nitrogen content is not more than 0.0008% by mass, the addition of boron, which is indispensable to the steel according to the present invention, comes to be unnecessary. Therefore, according to the present invention, the nitrogen content is not less than 0.0008% by mass. The upper limit of the nitrogen content is not more than 0.0050% by mass from the viewpoint of the balance between the nitrogen content and the boron content which is determined in relationship with the content of oxygen in the steel. The nitrogen content is preferably not more than 0.0040% by mass.

In the present invention, boron also is an element which is important for regulating the state of BN. The higher the boron content, the better the regulation of the state of BN. In the steel according to the present invention which has high oxygen content, however, an attempt to incorporate a large amount of boron results in lowered yield in the steelmaking process. For this reason, the upper limit of the boron content is 0.0050% by mass. The lower limit of the boron content is not less than 0.6 time the nitrogen content.

Oxygen directly affects the anti-fishscale property and, at the same time, in relationship with the manganese content, affects the adhesion to porcelain enamel and the anti-seed and anti-black-speck properties. In order to attain these effects, the oxygen content should be at least 0.005% by mass. On the other hand, when the oxygen content is high, the yield of boron added in steelmaking is lowered and, consequently, boron nitride cannot be maintained in a good state. This deteriorates the formability, anti-aging property, and anti-seed and anti-black-speck properties. Therefore, the upper limit of the oxygen content is 0.050% by mass. The oxygen content is preferably in the range of 0.010 to 0.045% by mass.

The oxygen content necessary for providing good enameling properties is influenced by the boron content. In conventional steel plates for enameling, about 0.02% by mass of oxygen has been necessary. By contrast, steels having a boron content falling within the content range specified in the present invention have good enameling properties even in the case of lower oxygen content, and, in particular, have good anti-fishscale property. The reason for this is considered attributable to the fact that the presence of boron affects the form of oxide at the stage of steelmaking. This is also inferred from the fact that, when the amount of boron added is excessive, the necessary amount of oxygen is increased to substantially the same amount of oxygen as necessary in conventional steels. The influence of boron content on proper oxygen content for the anti-fishscale property is shown in FIG. 1.

The regulation of the type and amount of boron nitride is important to the present invention, and a requirement represented by the following formula should be satisfied: (nitrogen present as BN)/(nitrogen present as AlN)≧10.0, or (nitrogen present as BN)/(nitrogen content)≧0.80. Preferably, the following relationship is satisfied: (nitrogen present as BN)/(nitrogen present as AlN)≧20.0, or (nitrogen present as BN)/(nitrogen content)≧0.90.

Although the reason for this has not been fully elucidated yet, the reason is believed to reside in that the fixation of nitrogen as a nitride, particularly as stable boron nitride, which is considered to be less likely to be decomposed during the annealing or porcelain enamel baking process, is useful from the viewpoints of the anti-aging property and the anti-seed and anti-black-speck properties.

Here (nitrogen present as BN) and (nitrogen present as AlN) are values obtained by analyzing dregs after the dissolution of a steel plate in an alcohol solution of iodine to determine the amount of boron and the amount of aluminum which are wholly regarded respectively as BN and AlN to determine the amount of nitrogen present as BN and the amount of nitrogen present as AlN.

The size distribution of BN also is a factor which is important for improving the anti-aging property and the anti-seed and anti-black-speck properties. In the present invention, the proportion of the number of precipitates having a diameter of not more than 0.010 μm in the number of precipitates of BN alone and BN-containing composite precipitates having a diameter of not less than 0.005 μm and not more than 0.5 μm is limited to not more than 10%, and the average diameter of precipitates of BN alone and BN-containing composite precipitates having a diameter of not less than 0.005 μm and not more than 0.5 μm is limited to not less than 0.010 μm.

The reason for this has not been fully elucidated yet. The reason, however, is believed as follows. Although boron nitride is stable at high temperatures, for example, in the annealing or porcelain enamel baking process, fine boron nitride having a size of less than 0.010 μm is unstable and is likely to be decomposed and thus is considered to deteriorate the anti-aging property and the anti-seed and anti-black-speck properties.

The number and diameter of the precipitates are obtained by observing a replica, extracted from the steel plate by the SPEED method, under an electron microscope to measure the diameter of precipitates and to count the number of precipitates in an even field of view. Alternatively, the size distribution may be determined by photographing several fields of view and performing image analysis or the like.

The reason why the diameter of BN is limited to not less than 0.005 μm is that the quantitative and qualitative analyses of fine precipitates are not satisfactory in accuracy even by the latest measurement techniques and are likely to involve a large error.

The reason why the diameter of BN is limited to not more than 0.50 μm is as follows. When boron is present in coarse oxides contained in a large amount in the steel according to the present invention, this is unfavorably measured. Therefore, in this case, there is a fear of causing a large error in the results of measurement of nitrides.

For this reason, in the present invention, the size distribution of BN is specified to the above-defined range in relationship with precipitates of size which can be expected to provide a smaller measurement error.

Further, particularly, in the case of precipitation of BN together with MnS, elongated shapes are sometimes observed. For precipitates not having an isotropic shape, the average of major diameter and minor diameter is regarded as the diameter of the precipitate.

It is well known in the art that copper functions to decelerate the speed of pickling as the pretreatment for enameling and to improve the adhesion to porcelain enamel. In particular, the addition of copper in an amount of about 0.02% by mass for attaining the effect of copper in direct-on one enameling is not detrimental to the effect of the present invention. In the present invention, however, the amounts of carbon and nitrogen in solid solution in the steel are very small. Therefore, when the pickling inhibitory action is excessively strong, the adhesion to porcelain enamel is lowered in the case of short pickling time. For the above reason, the upper limit of the amount of copper added should be about 0.04% by mass.

Carbonitride formers, such as titanium and niobium, are generally added to improve particularly deep-drawability. In the steel according to the present invention, however, the carbonitride formers are not added. The presence of carbonitride formers in an unavoidable amount derived, for example, from ores or scraps, however, has no significant adverse effect. Although the inclusion of vanadium, molybdenum, tungsten and other carbonitride formers in addition to titanium and niobium is considered, the content of the carbonitride former in terms of the total content of titanium and niobium as representative carbonitride formers is not more than 0.010% by mass, preferably not more than 0.006% by mass.

Next, the production process of the present invention will be described.

The state of precipitates contemplated in the present invention is provided by combining hot rolling, cold rolling, and skin pass after casting of a steel having a chemical composition specified in the present invention. Preferred conditions are as follows.

The effect of the present invention can be attained in any casting method. The regulation of boron nitride in the above-described manner is greatly influenced by the slab heating temperature and coiling temperature at the time of hot rolling. When the reheating temperature of the semi-finished steel product is 1000 to 11500° C. and/or the coiling temperature is 650 to 750° C., the proportion of the precipitation of BN and the precipitate size distribution are shifted toward more preferred values in the respective proportion range and size range specified in the present invention. Further, holding a coiled steel strip at a high temperature after rough rolling in the course of hot rolling, such as continuous hot rolling, is also effective.

The reduction in cold rolling is preferably not less than 60% from the viewpoint of providing good steel plates having good deep-drawability. In particular, when the deep-drawability is required, the cold rolling reduction is preferably not less than 75%.

For annealing, the effect of the present invention can be attained in any of box annealing and continuous annealing so far as the temperature is at or above the recrystallization temperature. Continuous annealing is preferred particularly from the viewpoint of low cost which is a feature of the present invention. In the steel according to the present invention, the recrystallization can be advantageously completed at 630° C. even in the case of short-time annealing. Therefore, there is no need to intentionally perform annealing at high temperatures.

Skin pass rolling is carried out to straighten the shape of the steel plate or to suppress the occurrence of elongation at yield point at the time of working. In order to suppress the elongation at yield point while avoiding the deterioration in workability (elongation) at the time of rolling, skin pas rolling is generally carried out with a reduction in the range of about 0.6 to 2%. In the steel according to the present invention, however, the occurrence of the elongation at yield point can be suppressed without skin pass rolling, and, in addition, no significant deterioration in workability takes place even in skin pass rolling with a relatively high reduction. For this reason, in the production of the steel according to the present invention, the reduction in the skin pass rolling is limited to not more than 5.0%. In the present invention, in some cases, the skin pass rolling is not carried out. Therefore, the expression "not more than 5.0%" means that a reduction of "0%" is embraced.

EXAMPLES

Continuously cast slabs having various chemical compositions shown in Table 1 were hot rolled, cold rolled, annealed, and temper rolled under conditions shown in Table 2. For the steel plates thus obtained, the state of nitrides is shown in Table 2, and the mechanical properties and enameling properties are shown in Table 3.

The mechanical properties were evaluated by a tensile test using JIS test piece No. 5. The aging index (AI) is a difference in stress between before and after the application of a 10% pre-strain by tension followed by aging at 100° C. for 60 min.

The enameling properties were evaluated in a process shown in Table 4. Regarding surface properties in terms of seeds and black specks among the enameling properties, a long pickling time of 20 min was selected, and the surface properties were evaluated by visual inspection. For the adhesion to porcelain enamel, a short pickling time of 3 min was selected for the evaluation. P.E.I. Adhesion Test (ASTM C 313-59) commonly used in the art does not clarify the difference in adhesion to porcelain enamel between test pieces. For this reason, the following method was used. Specifically, a 2-kg weight having a spherical head was dropped from a height of 1 m, and the state of separation of the porcelain enamel in the deformed portion was measured by 169 contact needles, and the adhesion to porcelain enamel was evaluated in terms of the percentage area of unseparated portion.

The anti-fishscale property was evaluated by the following fishscale acceleration test. Specifically, three steel plates were pretreated under conditions of a pickling time of 3 min and no nickel immersion treatment. A glaze for direct-on one enameling was applied. The coated steel plates were dried, was placed in a baking furnace at a dew point of 50° C. and a temperature of 850° C. for 3 min to bake the coating, and was then placed in a thermostatic chamber of 160° C. for 10 hr. Thereafter, the enameled steel plates were visually inspected for fishscale.

As is apparent from the results shown in Table 3, the steel plates of the present invention are steel plates for enameling which have good formability (elongation), good anti-aging property, and excellent enameling properties.

TABLE 1

(Unit: Mass %)

| Steel | C | Si | Mn | P | S | Al | N | B | O | Ti | Nb | B/N |
|---|---|---|---|---|---|---|---|---|---|---|---|---|
| a | 0.0015 | 0.005 | 0.25 | 0.013 | 0.022 | 0.001 | 0.0023 | 0.0031 | 0.037 | 0.002 | 0.001 | 1.35 |
| b | 0.0012 | 0.008 | 0.11 | 0.016 | 0.019 | 0.002 | 0.0016 | 0.0016 | 0.016 | 0.001 | 0.001 | 1.00 |
| c | 0.0016 | 0.011 | 0.08 | 0.015 | 0.025 | 0.002 | 0.0032 | 0.0038 | 0.020 | 0.003 | 0.001 | 1.19 |
| d | 0.0010 | 0.008 | 0.19 | 0.021 | 0.014 | 0.003 | 0.0022 | 0.0020 | 0.013 | 0.000 | 0.001 | 0.91 |
| e | 0.0018 | 0.006 | 0.22 | 0.026 | 0.020 | 0.001 | 0.0034 | 0.0021 | 0.033 | 0.001 | 0.000 | 0.62 |
| f | 0.0017 | 0.009 | 0.25 | 0.008 | 0.007 | 0.001 | 0.0043 | 0.0030 | 0.040 | 0.000 | 0.000 | 0.70 |
| g | 0.0014 | 0.012 | 0.16 | 0.015 | 0.025 | 0.004 | 0.0030 | 0.0023 | 0.022 | 0.002 | 0.002 | 0.78 |
| h | 0.0020 | 0.010 | 0.15 | 0.007 | 0.021 | 0.001 | 0.0035 | 0.0024 | 0.046 | 0.001 | 0.000 | 0.69 |
| i | 0.0009 | 0.004 | 0.14 | 0.020 | 0.020 | 0.003 | 0.0033 | 0.0019 | 0.035 | 0.004 | 0.000 | 0.58 |
| j | 0.0012 | 0.002 | 0.10 | 0.011 | 0.018 | 0.004 | 0.0052 | 0.0058 | 0.009 | 0.002 | 0.002 | 1.12 |
| k | 0.0011 | 0.008 | 0.22 | 0.023 | 0.014 | 0.002 | 0.0052 | 0.0036 | 0.014 | 0.003 | 0.001 | 0.69 |
| l | 0.0016 | 0.009 | 0.21 | 0.025 | 0.020 | 0.002 | 0.0021 | 0.0016 | 0.027 | 0.002 | 0.009 | 0.76 |
| m | 0.0014 | 0.006 | 0.23 | 0.026 | 0.022 | 0.001 | 0.0036 | 0.0038 | 0.030 | 0.010 | 0.002 | 1.06 |
| n | 0.0012 | 0.006 | 0.20 | 0.016 | 0.022 | 0.009 | 0.0014 | 0.0018 | 0.009 | 0.004 | 0.004 | 1.29 |
| o | 0.0011 | 0.005 | 0.20 | 0.016 | 0.022 | 0.005 | 0.0025 | 0.0020 | 0.005 | 0.002 | 0.001 | 0.80 |
| p | 0.0009 | 0.004 | 0.15 | 0.020 | 0.020 | 0.012 | 0.0026 | 0.0022 | 0.003 | 0.003 | 0.001 | 0.85 |

TABLE 2

| No. | Steel | Hot rolling temp., ° C. Heating | Hot rolling temp., ° C. Coiling | Cold rolling reduction, % | Annealing, ° C. × min | Skin pass, % | Equation 1 | Equation 2 | RA/μm | RS, % |
|---|---|---|---|---|---|---|---|---|---|---|
| 1 | a | 1200 | 600 | 75 | 750 × 1 | 0.6 | >20 | 0.87 | 0.021 | 6 |
| 2 | | 1050 | 640 | 80 | 775 × 1 | 0.6 | >20 | 1.00 | 0.018 | 2 |
| 3 | | 1200 | 730 | 80 | 775 × 1 | 0.6 | 18.5 | 0.96 | 0.024 | 8 |
| 4 | b | 1200 | 600 | 60 | 750 × 1 | 0.8 | 14.1 | 0.75 | 0.015 | 20 |
| 5 | | 1150 | 730 | — | — | 1.0 | 15.5 | 0.89 | 0.020 | 10 |
| 6 | c | 1150 | 720 | 80 | 700 × 1 | 1.0 | 17.4 | 0.90 | 0.016 | 5 |
| 7 | d | 1200 | 690 | 65 | 775 × 1 | 1.0 | 17.5 | 0.89 | 0.016 | 8 |
| 8 | | 1200 | 690 | 65 | 775 × 1 | 0.0 | 17.5 | 0.89 | 0.016 | 8 |
| 9 | | 1200 | 690 | 65 | 775 × 1 | 3.0 | 17.5 | 0.89 | 0.016 | 8 |
| 10 | | 1200 | 690 | 65 | 775 × 1 | 5.0 | 17.5 | 0.89 | 0.016 | 8 |
| 11 | e | 1200 | 650 | 80 | 750 × 1 | 0.8 | 12.5 | 0.91 | 0.018 | 8 |
| 12 | | 1250 | 650 | 80 | 750 × 1 | 0.8 | 9.8 | 0.86 | 0.013 | 12 |
| 13 | | 1250 | 550 | 80 | 750 × 1 | 0.8 | 9.4 | 0.75 | 0.009 | 20 |
| 14 | f | 1200 | 630 | 70 | 725 × 1 | 0.8 | >20 | 0.83 | 0.016 | 5 |
| 15 | | 1250 | 600 | 70 | 725 × 1 | 0.8 | 14.0 | 0.77 | 0.008 | 20 |
| 16 | | 1250 | 550 | 70 | 725 × 1 | 0.8 | 8.8 | 0.70 | 0.007 | 35 |
| 17 | g | 1250 | 630 | 60 | 750 × 1 | 0.8 | 13.1 | 0.98 | 0.029 | 2 |
| 18 | | 1250 | 600 | 60 | 800 × 1 | 0.8 | 12.4 | 0.83 | 0.020 | 10 |
| 19 | | 1250 | 600 | 60 | 825 × 1 | 0.8 | 12.4 | 0.78 | 0.009 | 40 |
| 20 | h | 1200 | 680 | 75 | 725 × 1 | 1.0 | 18.8 | 1.00 | 0.021 | 5 |
| 21 | | 1200 | 680 | 75 | 725 × 1 | 0.0 | 18.8 | 1.00 | 0.021 | 5 |
| 22 | | 1200 | 680 | 75 | 725 × 1 | 3.0 | 18.8 | 1.00 | 0.021 | 5 |
| 23 | | 1200 | 680 | 75 | 725 × 1 | 5.0 | 18.8 | 1.00 | 0.021 | 5 |
| 24 | i | 1150 | 710 | 85 | 750 × 1 | 0.8 | 9.5 | 0.84 | 0.013 | 15 |
| 25 | | 1050 | 750 | 85 | 750 × 1 | 0.8 | 9.8 | 0.81 | 0.015 | 8 |
| 26 | j | 1100 | 690 | 75 | 725 × 1 | 1.0 | >20 | 0.95 | 0.025 | 5 |
| 27 | k | 1150 | 610 | 65 | 750 × 1 | 1.0 | 16.4 | 0.80 | 0.017 | 15 |
| 28 | | 1150 | 610 | 65 | 750 × 1 | 2.0 | 16.4 | 0.80 | 0.017 | 15 |
| 29 | l | 1150 | 600 | 60 | 775 × 1 | 0.6 | 18.6 | 0.87 | 0.011 | 8 |
| 30 | m | 1150 | 650 | 70 | 775 × 1 | 0.8 | >20 | 0.87 | 0.014 | 6 |
| 31 | n | 1100 | 670 | 70 | 775 × 1 | 0.8 | 15.0 | 0.85 | 0.018 | 5 |
| 32 | o | 1150 | 700 | 75 | 800 × 1 | 0.8 | 14.3 | 0.92 | 0.032 | 2 |
| 33 | p | 1100 | 700 | 70 | 775 × 1 | 0.8 | 9.1 | 0.79 | 0.022 | 4 |

Equation 1: (N present as BN)/(N present as AlN)
Equation 2: (N present as BN)/(N content)
RA: Average diameter of precipitates of BN alone or BN-containing composite precipitates having a diameter of not less than 0.005 μm and not more than 0.50 μm
RS: The proportion of the number of precipitates having a diameter of not more than 0.010 μm in the number of precipitates of BN alone or BN-containing composite precipitates having a diameter of not less than 0.005 μm and not more than 0.50 μm

TABLE 3

| | Mechanical properties | | | Aging | Enameling properties | | | |
|---|---|---|---|---|---|---|---|---|
| Steel | YP/MPa | TS/MPa | El, % | property AI/MPa | Anti-fishscale property | Adhesion, % | Surface properties | Remarks |
| 1 | 150 | 296 | 53 | 0.0 | ◎ | 100 | ◎ | ◎Steel of inv. |
| 2 | 162 | 298 | 55 | 0.0 | ◎ | 100 | ◎ | ◎Steel of inv. |
| 3 | 149 | 276 | 58 | 0.0 | ◎ | 100 | ◎ | ◎Steel of inv. |
| 4 | 166 | 290 | 52 | 0.0 | ◎ | 100 | ○ | ○Steel of inv. |
| 5 | 152 | 290 | 50 | 0.2 | ◎ | 100 | ◎ | ◎Steel of inv. |
| 6 | 175 | 313 | 48 | 0.0 | ◎ | 100 | ◎ | ◎Steel of inv. |
| 7 | 149 | 288 | 56 | 0.0 | ◎ | 100 | ◎ | ◎Steel of inv. |
| 8 | 140 | 286 | 58 | 0.5 | ◎ | 100 | ◎ | ◎Steel of inv. |
| 9 | 160 | 292 | 54 | 0.0 | ◎ | 100 | ◎ | ◎Steel of inv. |
| 10 | 170 | 305 | 53 | 0.0 | ◎ | 100 | ◎ | ◎Steel of inv. |
| 11 | 160 | 292 | 52 | 0.0 | ◎ | 100 | ◎ | ◎Steel of inv. |
| 12 | 161 | 300 | 52 | 0.0 | ◎ | 100 | ○ | ○Steel of inv. |
| 13 | 168 | 310 | 53 | 0.0 | ◎ | 80 | X | X Comp. steel |
| 14 | 165 | 300 | 52 | 0.0 | ◎ | 100 | ○ | ○Steel of inv. |
| 15 | 172 | 299 | 48 | 0.0 | ◎ | 100 | ○ | ○Steel of inv. |
| 16 | 174 | 306 | 47 | 0.0 | ◎ | 90 | ○ | ○Steel of inv. |
| 17 | 162 | 290 | 52 | 0.0 | ◎ | 100 | ○ | ○Steel of inv. |
| 18 | 154 | 280 | 55 | 0.0 | ◎ | 100 | ○ | ○Steel of inv. |
| 19 | 141 | 269 | 57 | 0.4 | ○ | 90 | ○ | ○Steel of inv. |
| 20 | 162 | 298 | 50 | 5.6 | ◎ | 100 | ◎ | X Comp. steel |
| 21 | 150 | 306 | 52 | 23.4 | ◎ | 100 | ◎ | X Comp. steel |
| 22 | 168 | 306 | 44 | 1.4 | ◎ | 100 | ◎ | X Comp. steel |
| 23 | 177 | 315 | 42 | 0.0 | ◎ | 100 | ◎ | X Comp. steel |
| 24 | 152 | 290 | 52 | 0.0 | ◎ | 95 | X | X Comp. steel |
| 25 | 149 | 281 | 57 | 0.0 | ◎ | 100 | X | X Comp. steel |
| 26 | 155 | 297 | 49 | 0.0 | X | 100 | ◎ | X Comp. steel |
| 27 | 156 | 300 | 50 | 7.0 | ○ | 100 | X | X Comp. steel |
| 28 | 162 | 308 | 45 | 0.0 | ○ | 100 | X | X Comp. steel |
| 29 | 146 | 296 | 55 | 0.0 | ◎ | 90 | X | X Comp. steel |
| 30 | 142 | 290 | 54 | 0.0 | ◎ | 90 | X | X Comp. steel |
| 31 | 160 | 298 | 51 | 0.0 | ◎ | 100 | ◎ | ○Steel of inv. |
| 32 | 160 | 311 | 50 | 0.0 | ○ | 100 | ◎ | ○Steel of inv. |
| 33 | 162 | 297 | 50 | 0.0 | X | 100 | ◎ | X Comp. steel |

TABLE 4

| | Step | Conditions |
|---|---|---|
| 1 | Degreasing | Degreasing with alkali |
| 2 | Hot water washing | |
| 3 | Water washing | |
| 4 | Pickling | 15% $H_2SO_4$, 75° C. × 3, 20 min immersion |
| 5 | Water washing | |
| 6 | Ni treatment | 2% $NiSO_4$, 70° C. × 3 min immersion |
| 7 | Water washing | |
| 8 | Neutralization | 2% $Na_2CO_3$, 75° C. × 5 min immersion |
| 9 | Drying | |
| 10 | Glazing | Application of glaze for direct-on one coating, thickness 100 μm thickness |
| 11 | Drying | 160° C. × 10 min |
| 12 | Baking | 840° C. × 3 min |

As is apparent from the foregoing detailed description, the steel plates for enameling according to present invention have good formability and, at the same time, satisfies all of anti-fishscale property, adhesion of porcelain enamel, and surface properties required of steel plates for enameling. In particular, steel plates having excellent formability and anti-aging property can be produced without the use of decarbonization annealing or decarbonization-denitrification annealing unlike conventional high oxygen steels and, in addition, without the use of any expensive element unlike titanium-added and niobium-added steels. Therefore, the present invention has the effect of greatly reducing cost and thus is very useful in industry.

What is claimed is:

1. A steel plate for enameling, having improved formability, anti-aging property, and enameling properties, comprising by mass carbon: not more than 0.0018%, silicon: not more than 0.020%, manganese: 0.10 to 0.30%, phosphorus: 0.010 to 0.035%, sulfur: not more than 0.035%, aluminum: not more than 0.010%, nitrogen: 0.0008 to 0.0050%, boron: not more than 0.0050% and not less than 0.6 time the nitrogen content, and oxygen: 0.005 to 0.050%, (nitrogen present as BN)/(nitrogen present as AlN) being not less than 10.0, with the balance consisting of iron and unavoidable impurities.

2. A steel plate for enameling, having improved formability, anti-aging property, and enameling properties, comprising by mass carbon: not more than 0.0018%, silicon: not more than 0.020%, manganese: 0.10 to 0.30%, phosphorus: 0.010 to 0.035%, sulfur: not more than 0.035%, aluminum: not more than 0.010%, nitrogen: 0.0008 to 0.0050%, boron: not more than 0.0050% and not less than 0.6 time the nitrogen content, and oxygen: 0.005 to 0.050%, (nitrogen present as BN)/(nitrogen content) being not less than 0.80, with the balance consisting of iron and unavoidable impurities.

3. A steel plate for enameling, having improved formability, anti-aging property, and enameling properties, comprising by mass carbon: not more than 0.0018%, silicon: not more than 0.020%, manganese: 0.10 to 0.30%, phosphorus: 0.010 to 0.035%, sulfur: not more than 0.035%, aluminum: not more than 0.010%, nitrogen: 0.0008 to 0.0050%, boron: not more than 0.0050% and not less than 0.6 time the nitrogen content, and oxygen: 0.005 to 0.050%, the average diameter of precipitates of BN alone or BN-containing composite precipitates having a diameter of not less than 0.005 μm, and not more than 0.50 μm being not less than 0.010 μm, not more than 10% of the number of precipitates of BN alone or BN-containing composite precipitates having a diameter of not less than 0.005 μm and not more than 0.50 μm being accounted for by precipitates having a diameter of not more than 0.010 μm, with the balance consisting of iron and unavoidable impurities.

* * * * *